United States Patent [19]

Bishop

[11] 4,127,337

[45] Nov. 28, 1978

[54] BUSINESS MACHINE INKING DEVICE AND METHOD OF INKING BUSINESS MACHINES

[75] Inventor: John W. H. Bishop, Springdale, Conn.

[73] Assignee: Ibex Inking Systems, Inc., Fairfield, Conn.

[21] Appl. No.: 747,809

[22] Filed: Dec. 6, 1976

[51] Int. Cl.[2] ..... B41F 31/16

[52] U.S. Cl. ..... 400/202.4; 400/200; 101/367; 427/141; 118/264; 118/267

[58] Field of Search ..... 197/171, 175, 151, 150; 401/120; 118/260, 264; 427/267, 268, 141, 428; 101/331, 367

[56] References Cited

U.S. PATENT DOCUMENTS

| | | | |
|---|---|---|---|
| 916,357 | 3/1909 | McCarty | 101/367 |
| 1,670,696 | 5/1928 | Stuhr | 118/260 |
| 1,988,305 | 1/1935 | Dunn et al. | 197/171 |
| 2,172,550 | 9/1939 | Stull | 118/267 |
| 2,965,911 | 12/1960 | Hempel et al. | 101/367 |
| 3,072,053 | 1/1963 | Becker et al. | 197/171 |
| 3,168,865 | 2/1965 | Kelly | 101/367 |
| 3,460,665 | 8/1969 | Dodsworth et al. | 197/175 |
| 3,887,727 | 6/1975 | Ploeger, Jr. et al. | 197/171 |
| 3,948,382 | 4/1976 | Nesbitt et al. | 197/171 |
| 3,951,253 | 4/1976 | Tibay et al. | 197/171 |

FOREIGN PATENT DOCUMENTS

| | | | |
|---|---|---|---|
| 640,738 | 1/1937 | Fed. Rep. of Germany | 197/171 |

*Primary Examiner*—William Pieprz
*Attorney, Agent, or Firm*—David B. Miller

[57] ABSTRACT

An inking device and a method of inking business machines are disclosed in which the inking device has a spool-like body with a central ink reservoir, and an ink conducting washer-like pad of cellular plastic material is in communication with the ink reservoir to receive ink from the reservoir near its inner periphery and to conduct it by capillary action to its exposed outer periphery situated beneath a tubular inking pad mounted on the hub of the spool-like body. The bottom of the inking pad is in contact with the exposed periphery of the ink conducting pad near the outer surface of the inking pad to pick up ink therefrom and to transmit ink upwardly of the inking pad by capillary action. Ink is delivered from the inking pad to a ribbon, or to a type slug, which contacts the inking pad to pick up ink therefrom as the ribbon or type slug moves past the inking pad.

21 Claims, 6 Drawing Figures

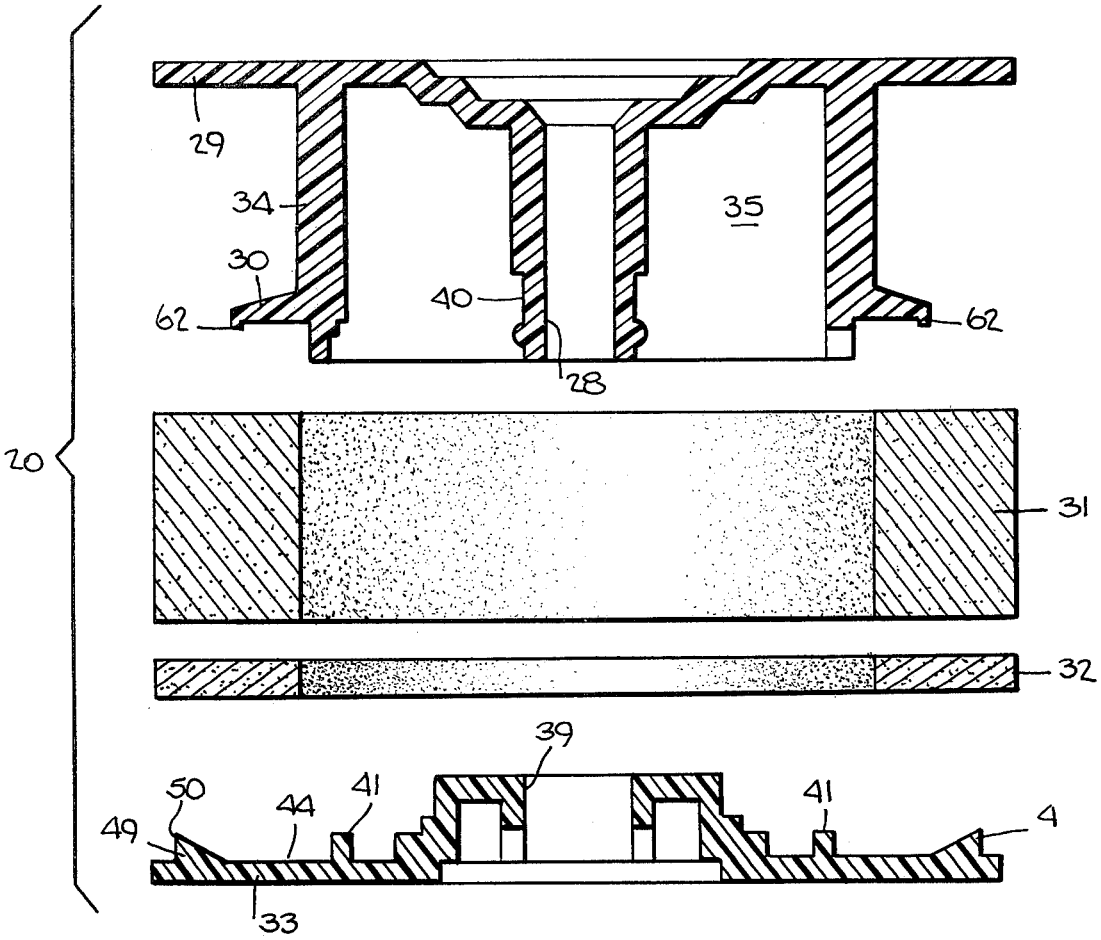
Fig. 1.
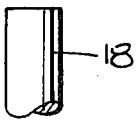
Fig. 2.
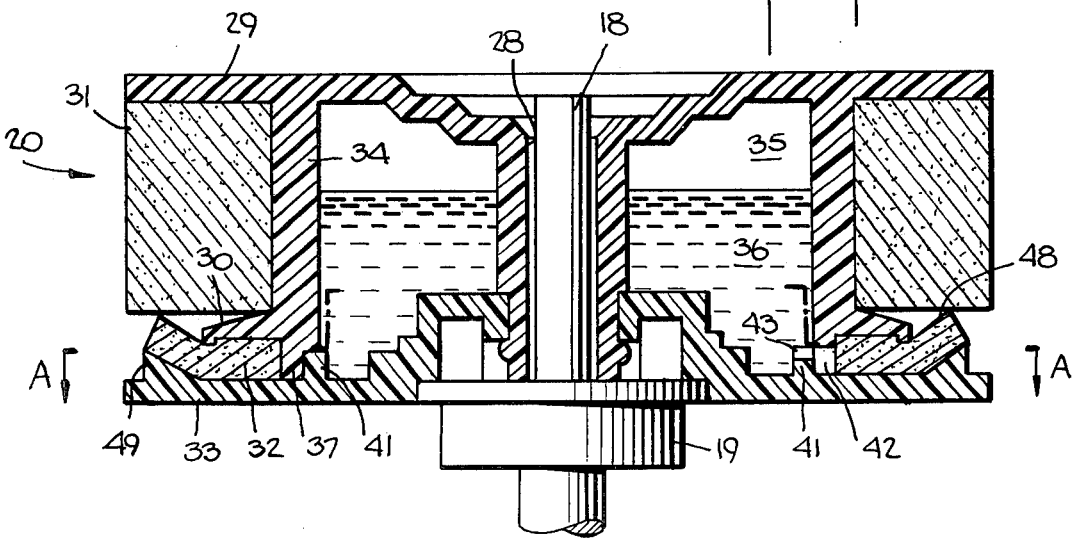

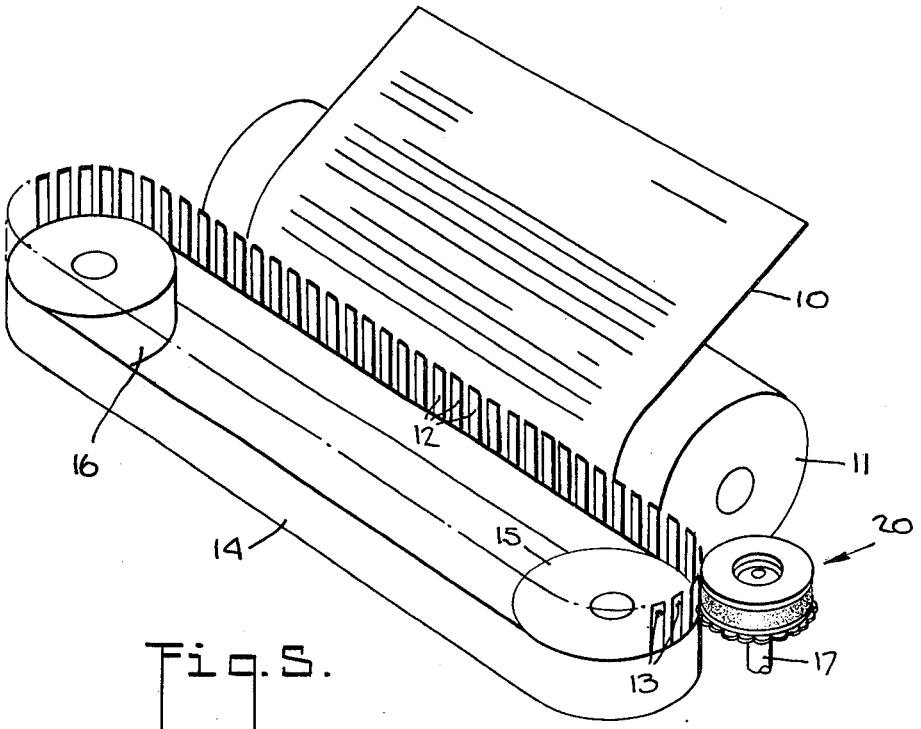
Fig. 5.
Fig. 6.
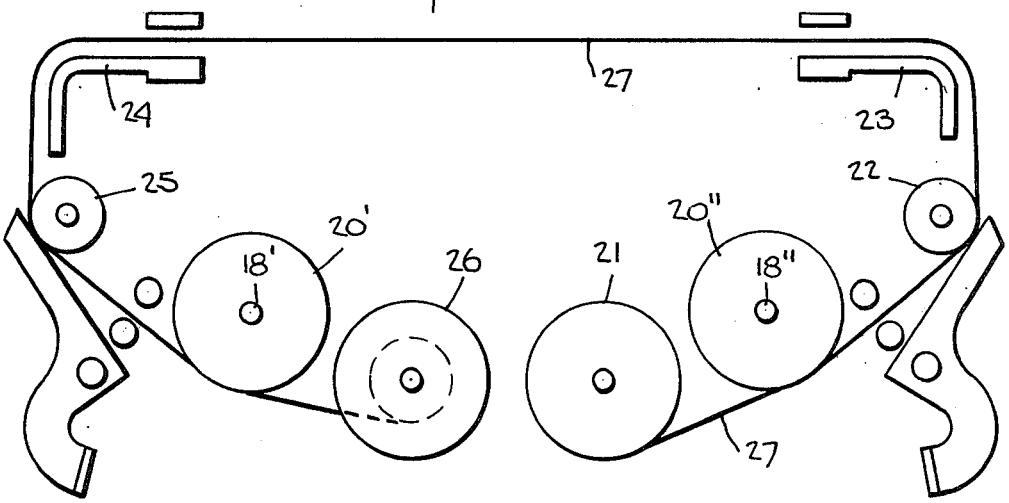

BUSINESS MACHINE INKING DEVICE AND METHOD OF INKING BUSINESS MACHINES

The present invention relates to an inking device and to a method of inking business machine typefaces directly or by an intermediary means such as a ribbon, and is usable, for example, in such business machines as teleprinters, typewriters, accounting machines, computer and data printers, and the like.

In my co-pending United States patent application Ser. No. 703,261, filed July 7, 1976 there is disclosed and claimed a printing ribbon spool and method of inking the type slug impact area of business machines which permits much longer operation of business machines between replacement of the ink source than had generally been obtained in commercial practice theretofore. The specific embodiments of the invention disclosed in that prior application are highly desirable ones and have wide utility.

But the specific embodiments illustrated in that prior application employ the invention in structures in which an inking ribbon is wound on the printing ribbon spool itself. Some manufacturers, and some machines, employ ribbons of very great lengths, for example 36 to 40 yards long, and within the dimensional limitations of some existing machines it may not always be possible, or if possible, convenient, to use the embodiments disclosed in that prior application with such long ribbons because the spools of that invention employ relatively large reservoirs for the ink supply and there simply may not be enough space left for the long ribbon without increasing the spool diameter beyond the desired or tolerable limits. Further, in some instances where the embodiments disclosed in that application are used, it may simply be desired to supplement or augment the ink supply even though that may already be relatively large. Additionally, some machines, for example the Dow Jones/GE model #300 printer, do not employ ribbons at all but rather transfer ink from an inking pad to the face of a type slug which in turn deposits the ink directly on the printing surface without the intervention of a ribbon.

The present invention is concerned with embodiments for use in business machines in which a ribbon is not wound directly on the inking device itself, but rather ink is delivered from an inking pad of this invention to an external ink receiving means which subsequently carries the ink to the printing surface, for example, to a type slug face for direct deposition therefrom on the printing surface, or to an inking ribbon from which it is deposited on the surface by a type slug or pin firing matrix mechanism impacting that ribbon in the usual way.

It is an object of this invention to provide an inking device and a method of inking business machines in which ink is supplied to an external ink receiving means from an inking pad on the inking device. It is a further object of this invention to provide an inking device and a method of inking business machines in which ink is conducted from an ink reservoir and delivered to the outer area of an exposed inking pad at its lower portion, and is transmitted upwardly of the inking pad by capillary action where it is available for delivery from the surface of the inking pad to an ink receiving means.

A still further object of this invention is to provide an inking device and method of inking business machines in which ink supplied to the external surface of an inking pad from a reservoir by an ink conducting pad which delivers ink to the bottom of the inking pad to be conducted upwardly of that inking pad is delivered to an ink receiving means by contact between that surface and the ink receiving means and is carried to the printing surface on the ink receiving means.

The foregoing and other objects and advantages of this invention are achieved in an apparatus and method in which a spool-like body has an ink receptacle cavity of relatively large capacity in the hub of the spool; a thin, washer-like pad of cellular material, preferably synthetic polymer such as polyurethane rubber or the like, is in communication with the ink receptacle, preferably at the bottom of the receptacle, and extends radially outwardly of the ink receptacle to have an outer portion of the pad exposed in contact with, and to supply ink to, the lower and radially outer portion of a tubular inking pad mounted on the hub of the spool-like body. The ink is in turn conveyed upwardly of the inking pad by capillary action and to the surface of the inking pad where it may be picked up by an ink receiving means, such as a ribbon or a type slug, advancing therepast in contact with that surface.

In a preferred embodiment of this invention, the inking device has a spool-like body with a hub and a lower flange extending radially outwardly from the hub and adapted to receive on the hub and above the flange a tubular inking pad of cellular polymeric material. A thin, washer-like ink conducting pad of cellular material is supported adjacent and beneath such lower flange with the flange between the washer-like pad and the tubular inking pad but with both the washer-like pad and the inking pad extending radially slightly beyond the periphery of the flange and contacting each other there. The spool-like body has a central ink reservoir which has ports to deliver ink to the radially inner portion of the washer-like pad; the ink is conducted through the cellular material making up the washer-like pad by capillary action to the portion of the washer-like pad in contact with the tubular inking pad where the ink is picked up by the lower portion of the tubular inking pad and is conveyed upwardly of the inking pad by capillary action where it can be picked up from the outer surface of the inking pad by a ribbon or type slug or the like which advances past the outer surface while being pressed thereagainst. When ink is to be delivered to a ribbon, an inking device of this invention can be positioned to be contacted by the ribbon either as it advances from its supply roll to the type slug impact area, or as it advances from the type slug impact area to its wind-up roll, or, and preferably, an inking device according to this invention can be positioned at both such locations so a relatively large supply of ink is available to the ribbon.

The invention will be better understood from the following detailed description of specific embodiments thereof when read in conjunction with the accompanying drawings, in which:

FIG. 1 is an exploded axial cross-section view of an inking device according to this invention taken along a diameter of its spool-like body;

FIG. 2 is an assembled view of the inking device of FIG. 1 filled with ink and positioned on a spindle for free rotation thereon;

Figure 3:
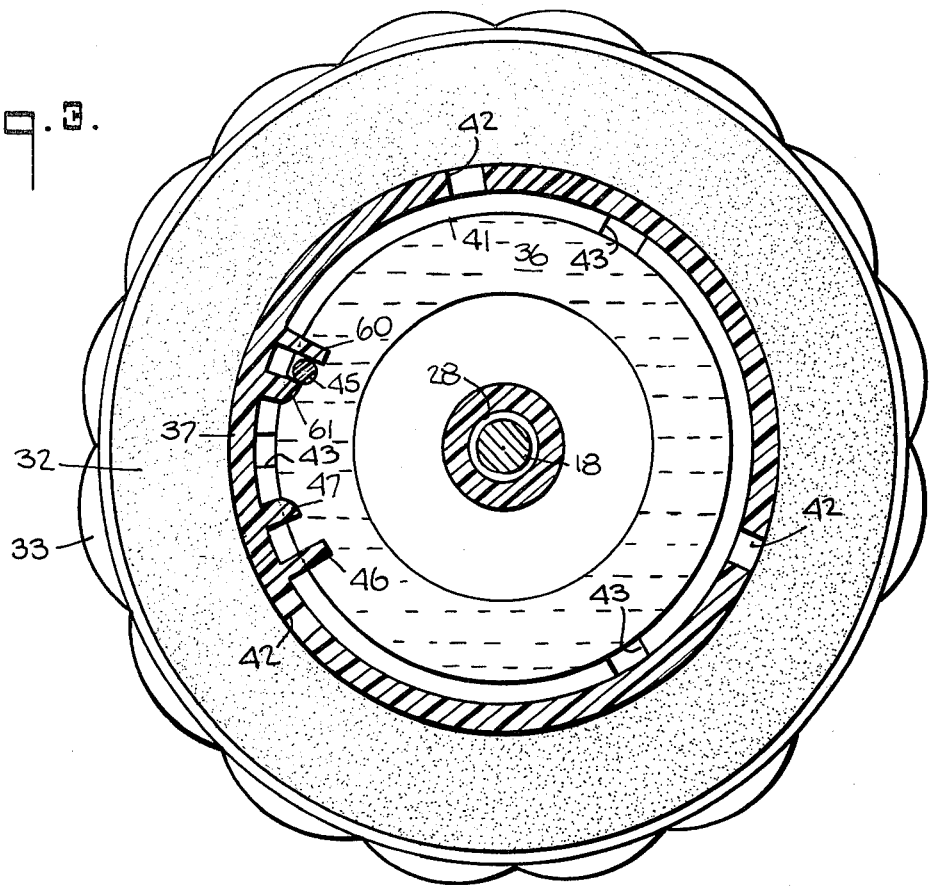
FIG. 3 is a cross-sectional view taken along the line A—A of FIG. 2 illustrating a closed position of an ink control feature of a novel construction which is used in the preferred embodiment of this invention.

FIG. 5 is a perspective, partly schematic, view of the printing area of a business machine known as the "ribbonless Dow Jones/GE model #300" utilizing an inking device of this invention to ink the type slugs as they advance past that inking device, and FIG. 6 is a partly schematic top plan view of a business machine known as the "Extel series AF teleprinter" modified to employ two inking devices according to this invention to deliver ink to the ribbon of the teleprinter as the ribbon advances to and from its take-up and supply spools respectively.

Referring to the drawing in detail, there is illustrated in FIGS. 5 and 6 two different ways in which the inking device of this invention might be used on business machines. FIG. 5 illustrates the well-known "Dow Jones/GE Model #300" printer in which the paper 10 advances around the usual back up roller 11, and in front of the type fingers 12 which have the type slugs 13 near their tops. The type fingers 12 are carried on the belt 14 trained on rollers 15, 16 which in turn are controlled by the machine to position the desired type slug in the printing position facing the print surface of the paper 10 on the roller 11. This Dow Jones modification has a sleeve 17 in which the spindle 18 (see FIGS. 1 and 2) is journaled on ball-bearings for free rotation, and the spindle 18 carries a stop 19 on which the spool-like inking device 20 rests. As is well-known, in the operation of the Dow Jones/Ge Model #300, the type slugs 13 advance past the inking device 20 where the type slugs 13 are pressed against an inking pad on the device 20 to pick up ink from the device directly on the type slugs 13, and these type slugs carrying the ink on their exposed outer surfaces are moved by the belt 14 under the control of the machine, to position the desired type character at the proper printing position opposite paper 10 whereupon the desired type finger 12 is actuated to impact the desired type slug 13 on the paper 10 to print the character on paper 10.

In FIG. 6 there is illustrated in partly schematic plan view the ribbon path of the Extel machine referred to above. In operation of this machine a twelve yard long ribbon 27 from a supply spool 21 advances past a guide roll 22, a machine arc 23 to a second machine arc 24, a second guide roll 25 and to a take up spool 26. Between the machine arcs 23 and 24, the ribbon is impacted by the pin firing matrix in the normal way between the pin firing matrix and the printing surface to deliver ink from the ribbon to the printing surface and print the matrix character thereon. In FIG. 6 this Extel machine has been modified to add two inking devices 20', 20" according to this invention. As there illustrated, the inking devices 20', 20" are positioned so that the inking ribbon is bent slightly around the devices 20', 20" to assure that the ribbon is pressed against the surface of the devices 20', 20" as the ribbon advances therepast. As is well known, the ribbon alternately passes back and forth between the spools 21, 26 so that at any given point in operation of the machine, either spool 21 or 26 might be regarded as the supply spool and the remaining one as the take-up spool. When the end of the ribbon is reached, the ribbon reverses directions and the spools change their characters. The inking devices 20', 20" are mounted for free rotation on spindles 18', 18" positioned as described, so that as the ribbon passes to or fro past the inking devices 20' 20" of this invention, it receives ink from the inking devices. Although two inking devices 20', 20" are illustrated in FIG. 6 and it is preferred that two would be used in a device of this type, it is apparent that if desired only a single inking device according to this invention may be used to deliver ink to the ribbon 27. It is to be noted that no modification need be made to the Extel printer to mount the device. A plate locking screw is merely replaced by a spindle the bottom of which has the same thread.

Referring now to FIGS. 1 and 2, there is illustrated the preferred embodiment of the improved inking device 20 of this invention. In general, the inking device shown in FIGS. 1 and 2 is similar to that embodiment shown in my prior co-pending application referred to above except the inking device 20 of this invention has no ribbon, consequently the ribbon anchor, eyelet flats, and corrugations of the embodiment of that prior application are not needed, and, most importantly, the inking device of this invention includes a tubular inking pad 31.

The improved inking device is a spool-like structure 20 and includes a hollow generally cylindrical spindle tube 28 having a pair of axially spaced flanges 29, 30 extending outwardly therefrom near the top and bottom of the tube. The lower flange 30 serves to separate the tubular inking pad 31 from the washer-like ink conducting pad 32 and to limit contact between the two pads to the radially outer areas of each where they project beyond the periphery of flange 30. The outwardly extending upper flange 29 forms an upper retention means for the inking pad 31.

As will become apparent as this description proceeds, when the inking device of this invention is used, the flange 29 will be higher than the flange 30, so flange 29 will be designated herein as an upper flange, and when the term lower flange is used herein it will refer to flange 30.

Like ribbon spools, the inking devices 20 of this invention are generally cylindrical in overall external outline, although, desirably, flange 29 and cap 33 are scallopped at their peripheries for ease of grasping, so they may be twisted relatively to each other.

The central, generally cylindrical spindle tube 28 is slightly larger in internal diameter than the external diameter of the business machine spindle 18 and is adapted to receive that spindle when the inking device is on the business machine as has been the case in the spindle tubes of the ribbon spools commonly used heretofore. But unlike those prior ribbon spools, the inking devices of this invention can be freely rotated on their spindles or, as in the Dow Jones machine, can be mounted on a freely rotatable spindle. It will be obvious, of course, that the inking device of this invention may itself be driven if desired, but generally it is expected that this will be found to be unnecesary.

The inking device hub has an outer wall 34 which is much larger in diameter than the spindle tube 28, so there is provided a relatively large cavity 35 between the spindle tube 28 and the outer wall 34 which cavity forms the ink reservoir of this invention and receives the ink as illustrated at 36 in FIG. 2. The top of this ink reservoir is closed by an inward continuation of the upper flange 29. Conveniently, the spindle tube 28, the outer wall 34, upper flange 29 and lower flange 30 can be formed in a single body unit as, for example, by molding it in a single piece from a suitable material, such as acetal resin which is found eminently suitable because of its chemical inertness to dye based inks commonly used.

A cap 33 is provided to generally close the ink reservoir, but with an important exception to be described. Although element 33 is called a "cap" herein, when the inking device 20 is used, cap 33 is disposed at the bottom of the inking device rather than at the top where "caps" are normally found. But when assembling the device 20, the preferred unitarily molded upper flange 29, spindle tube wall 28, hub wall 34, and lower flange 30 are position inverted with the lower flange 30 and the open end of the ink reservoir 35 uppermost. In this position the tubular inking pad 31 is forced past flange 30 and onto hub wall 34, the cellular ink metering washer 32 is placed atop flange 30 with its inner periphery surrounding a depending circular rib 37 on hub wall 34, the ink reservoir 35 is then "pour" filled with ink, the cap 33 is then put on, and, by a close fit between walls 39 on the cap and 40 on the spindle tube, united with the unitarily molded body unit to complete the assembled inking device 20. When thus assembled an upstanding circular rib 41 on cap 33 nests inside depending rib 37, and the ink reservoir 35 is completely closed except for slots in ribs 37, 41 which can be aligned to provide ink escape passages. The assembled inking device 20, filled to slightly below maximum ink capacity, is stored and shipped in an inverted position with the lower flange 30 above the upper flange 29 until the inking device is ready for use, at which time the inking device is inverted to its normal use position shown in the drawings.

A unique feature of the preferred inking device shown in FIGS. 1 and 2 is that feature disclosed and claimed in my co-pending application referred to which permits complete closure of the ink reservoir 35 for storing and shipping yet allows it to be opened when ready for use. This feature prevents ink leakage in storage and shipping and can be especially important where excessive heat or reduced atmospheric pressure is a factor. When the device is to be used, the operator can open the ink reservoir to permit ink flow to the washer-like pad 32 by simply twisting flange 29 and cap 33 relative to each other.

The construction which permits this is illustrated in FIGS. 1-4. The lower flange 30 and hub wall 34 unit has a downwardly extending circular rib 37 and the cap 33 has an upwardly extending circular rib 41. The elements are proportioned and arranged such that in the assembled position shown in FIG. 2, rib 41 fits snugly inside rib 37 to completely seal the ink reservoir against leakage save at the ink feed openings to be described. As appears best in FIGS. 3 and 4, rib 37 has one or more notches 42 extending therethrough at its lower edge. In the embodiment illustrated, and as appears in FIGS. 3 and 4, three such notches 42 are provided. Rib 41 also has one or more notches 43 extending therethrough at its upper edge. In the embodiment illustrated, and as best appears in FIGS. 3 and 4, three such notches 43 are provided through the upper edge of rib 41.

In one embodiment of the assembled ribbon spool, the lower surface of rib 37 contacts the upper surface 44 of cap 33 except at the notches 42. The three notches 42 in this application are spaced 120° apart around rib 37; similarly the three notches 43 are spaced 120° apart around rib 41. The cap 33 can be rotated relative to the reservoir body unit so the notches 42 and 43 may be disposed in non-aligning relationship, as shown in FIG. 3 so that no egress from reservoir 35 is provided for the ink therein, or alternatively, the cap 33 and reservoir body unit may be rotated so that notches 42, 43 are aligned, as illustrated in FIG. 4, to allow ink to flow from reservoir 35 through the three egress passages provided by aligned notches 42, 43 to the washer-like pad 32.

The cap 33 and reservoir body unit are assembled so these elements may be rotated with respect to each other, and means are provided to lock the inking device with the ink reservoir in a closed position yet to permit it to be opened and locked in an open position. In my prior co-pending application which is incorporated herein by this reference I disclose one such structure.

In the drawings attached hereto, I disclose a second such structure. This comprises a pair of limit ribs 46, 60 which project inwardly into the ink reservoir on the body unit and extend into the path of a locking pin 45 that upstands from the upper surface 44 of the cap 33 and is positioned radially inwardly a slight distance from the rib 41. The pin 45 projects upwardly a sufficient distance from surface 44, and the ribs 46, 60 extend downwardly on the inner hub wall 34 a sufficient distance, such that as pin 45 rotates with the cap unit 33, pin 45 can be moved from a position adjacent rib 60 where the reservoir is closed as illustrated in FIG. 3 to a position adjacent the rib 46 where the reservoir is open. The hub wall 34 also carries a pair of projecting detent ribs 47, 61 with the detent rib 47 spaced a little distance from the limit rib 46 and also projecting slightly into the path of pin 45 as pin 45 rotates, so that as pin 45 is moved from the closed position illustrated in FIG. 3 to the open position illustrated in FIG. 4 it must first be forced past detent 61 then past the second detent 47 to be confined in a small space between the latter detent 47 and limit rib 46 to lock the device in an open position against accidental closing. Similarly, the detent 61 is positioned a little distance from the limit rib 60 so that as pin 45 is rotated from the closed position illustrated in FIG. 4 to the open position illustrated in FIG. 3, the pin 45 must be pressed past detent 47 then past the second detent 61, so that the pin 45 will be confined in a small space between detent rib 61 and limit rib 60 to hold the unit in the closed position illustrated in FIG. 3.

Figure 4:
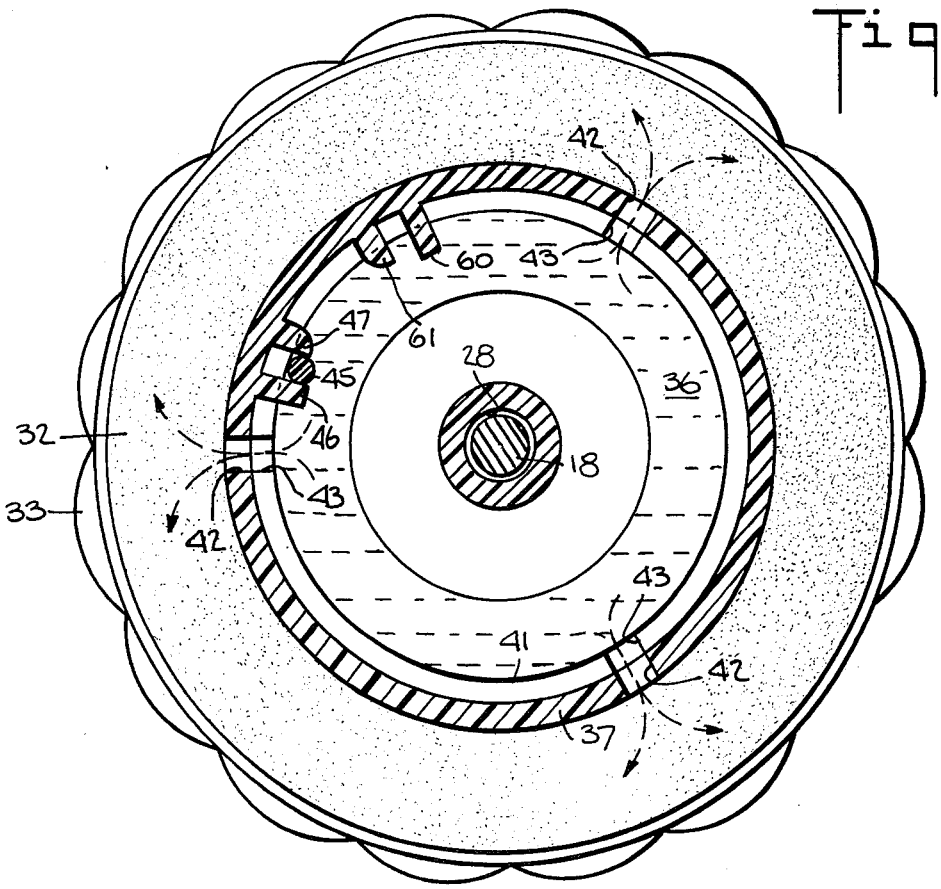
FIG. 4 is a cross-sectional view taken along the line A—A of FIG. 2 and corresponding to the view of FIG. 3 but with the ink control feature in its open position.

When assembled for storage and shipping, the elements will be locked in the closed position of FIG. 3 with notches 42 and 43 out of alignment and locking pin 45 confined between detent 61 and limit rib 60, and the user, when installing the device, simply grasps the flange 29 and cap 33 and twists them relative to each other to force locking pin 45 first past detent 61, then past detent 47 and into the narrow space between detent 47 and limit rib 46 which is the open position illustrated in FIG. 4 where notches 42 and 43 are aligned to permit ink to escape from reservoir 35 to pad 32.

It is an important element of this invention that ink conducting pad 32 of cellular material is positioned beneath the bottom flange 30 and has an outer portion thereof in contact with the bottom of inking pad 31 near the latter's outer periphery and has an inner portion communicating in ink-receiving relation with the ink reservoir 35. In one application this pad 32 is a washer-like pad which has an internal diameter substantially equal to the external diameter of rib 37, so the ink flowing through the passages formed by registering notches 42, 43 flows to, and is picked up by, the metering washer 32. The metering washer 32 is cylindrical in overall outline, but annular in plan and, preferably, has an external diameter slightly larger than the diameter of the lower flange 30 and approximately the same as the outer diameter (but for the scalloping) of the cap 33, so that when the devide is assembled, the radially inner area of the metering washer 32 receives ink from the ink reservoir and the radially outermost area of the metering washer 32 is exposed between the radially outermost perimeter of the lower flange 30 and the radially outer perimeter of the cap 33. In the embodiment shown, the cap 33 and lower flange 30 are constructed to tilt or cock the outer periphery of the metering washer 32 upwardly at a slight angle so that an inverted generally V-shaped portion 48 is presented to the bottom of tubular inking pad 31. At its outer periphery, cap 33 has an upwardly projecting circular rib 49, which, as shown, is triangular in radial cross-section and slopes upwardly from the surface 44 of cap 33 to provide an enlarged thickness at the radially outermost periphery 50 of the rib 49. The outer periphery of flange 30 terminates in the axial cylinder in which rib 49 commences. The rib 49 and flange 30, as appears best in FIG. 2, cooperate to tilt or cock-up the outer periphery of washer 32 to present the inverted V-surface 48 of washer 32 in the inking pad 31.

When the device 20 is assembled in operating position, ink from the ink reservoir 35 flows to the cellular metering pad 32 at the pad's radially inner area, and the ink passes through pad 32 by capillary action to the exposed periphery 48 thereof.

Various materials are suitable for the cellular metering pad 32 and the inking pad 31. Generally, the microcellular polymeric materials are preferred. One such commercially available product is the sponge-like urethane elastomer cellular material available under the trade name "Micro-well". This product, described at p. 12, December 1970 MODERN PLASTICS and in the technical literature of H. M. Storms Corp., Newport, N.Y., and of its current supplier Micro-well Inc., Miamisburg, Ohio, is a sponge-like material of polyurethne elastomer containing myriad microscopic pores; as much as 70% of the volume of the material is void. The voids, or pores, as appears in electron micrographs, interconnect and are irregular in shape and of various sizes; in one construction the voids have a pore "diameter" in the range of 13–14 microns. The product can be produced in annular cylinders, so it is a simple matter to slice from such cylinders thin washers suitable for use in this invention as the pads 32 or to mold, or cut from molded, tubes suitable for use as the inking pads 31.

Another suitable product, available commercially under the name "Accuflo" from Porelon Inc. of Racine, Wisconsin is a similar microporous polymeric material with interconnecting voids. This plastic sponge-like material also can be manufactured in annular cylinders from which the pads 31, 32 can readily be sliced.

As is well-known, these micro-cellular polymeric materials are somewhat soft and spongy to the touch, although finished products of varying hardnesses can be manufactured. Thus, Microwell can be manufactured in a Shore A durometer of 27; Accuflo is supplied in hardnesses in the range of 11 to 40 Shore A durometer, but it can be manufactured as high as 70 Shore A durometer. The relatively softer A durometer hardnesses of Accuflo are eminently suitable for the pads 31 and 32 of this invention and are currently preferred.

The foregoing microporous cellular materials work quite satisfactorily in this invention using an ink in which a dye is dissolved in oleic acid. This preferred ink has a long shelflife in the ribbon spools of this invention, for the ink in the reservoir of the assembled ribbon spool is not exposed to the open air.

It is important in this invention that the ink be conducted by the washer-like pad 32 to an area near the outer periphery of inking pad 31 and that it be there transferred to the bottom of that inking pad to, in turn, be conducted upwardly of the inking pad 31 by capillary action. The lower flange 30 helps set this ink path. In one specific embodiment of the device of this invention, ink conducting pad 32 is a washer-like pad 0.080 inches thich which has been sliced from a molded cylindrical tube of Accuflo $1\frac{7}{8}$ inches in external diameter and $1\frac{3}{8}$ inches in internal diameter. Inking pad 31 has been cut from a molded tube of Accuflo $1\frac{7}{8}$ inches in external diameter and $1\frac{3}{8}$ inches in internal diameter. In this specific embodiment where the distance, measured along the external diameter of hub wall 34 between the lower surface of flange 29 and the upper surface of flange 30 is 0.51 inches, the tubular inking pad 31 is 0.5 inches long.

In this embodiment, flange 30 is 1.7 inches in external diameter and projects 0.165 inches from the external surface of hub wall 34. The external surface of hub wall 34 in this embodiment is 1.37 inches in diameter. Accuflo is somewhat elastic, so tubular inking pad 31, $1\frac{3}{8}$ inches in internal diameter, is stretched slightly when it is pressed past the 1.7 inch diameter flange 30. In this specific embodiment described in this paragraph, the tube of inking pad 31 is $\frac{1}{4}$ inches thick from its internal to its external diameter, and since flange 30 projects 0.165 inches from the external surface of hub wall 34, the inner 0.165 inch e.g. substantially the inner two-thirds of inking pad 31 is isolated from, and held out of ink transfer contact with, ink conducting pad 32 by flange 31, so ink is transferred between these two pads at an area near the radially external surface, e.g. in substantially the outer one-third of the inking pad 31.

Additionally, the upper surface of flange 30 slopes downwardly 3° toward its outer periphery, as best appears in FIGS. 1 and 2, and a lip 62 protrudes downwardly 0.015 inches so the design spacing between the lower surface of inking pad 31 and the upper surface of ink conducting pad 32 of the embodiment described in the preceding paragraph, measured vertically of FIGS. 1 and 2, is 0.025 inches. Rib 49 and lip 62 cock-up the outer periphery of ink conducting pad 32, and the Accuflo inking pad 31 is sponge-like and, although light in weight, may nonetheless sag slightly on flange 30 in use, so the contact between pads 31 and 32 will occur between two generally concentric somewhat circular shaped limits in the outer 0.085 inches of pad 31's lower surface, and in such embodiment with a rib 49 0.065 inches high at its external surface 50, contact occurs in an area about 0.020 inches wide, measured radially of the device, with the outer border of the contact area being disposed approximately 0.018 inches in from the outer diameter of inking pad 31.

Having thus described my invention, what I claim and desire to protect by Letters Patent is:

1. An inking device comprising a spoollike body, said body having a hub, a lower flange extending radially outwardly from said hub, inking pad retention means on said hub, said hub being above said lower flange, an inking pad on said hub above said lower flange and retained by said retention means, an ink conducting pad of cellular material beneath said lower flange and having a portion thereof projecting outwardly from beneath said lower flange and exposed to contact a lower portion of said inking pad only radially outwardly of said lower flange near the ink delivery surface of said inking pad, said lower flange overlying said ink conducting pad to be positioned between said inking pad and said ink conducting pad inwardly of said projecting portion, an ink reservoir in said hub, said hub and said lower flange isolating said inking pad from said ink reservoir whereby ink from said reservoir may be conducted to said inking pad only at said exposed portion of said ink conducting pad, said ink conducting pad communicating in ink receiving relation with the ink reservoir to receive ink from said reservoir and conduct it to the portion thereof contacting said inking pad, said inking pad having an exposed ink delivery surface above said lower portion, said ink delivery surface being adapted to be contacted by an ink receiving means and to deliver ink thereto.

2. An inking device in accordance with claim 1 in which said inking pad is a tube of cellular material which surrounds said hub between said lower flange and said retention means.

3. An inking device in accordance with claim 2 in which said ink conducting pad is cocked-up near its outer periphery to contact said inking pad in a narrow band of contact.

4. An inking device in accordance with claim 3 in which said ink conducting pad is a washer-like pad about 0.800 inches thick and the tubular wall of the inking pad is about ¼ inches thick and the narrow band of contact between said pads is in the outer one-third of the thickness of the inking pad.

5. In combination, an inking device comprising a spool-like body, said body having a hub, a lower flange extending radially outwardly from said hub, inking pad retention means on said hub, said retention means being above said lower flange, a cellular polymeric inking pad on said hub above said lower flange and retained by said retention means, a cellular polymeric ink conducting pad beneath said lower flange and having a portion thereof projecting outwardly from beneath said lower flange and exposed to contact a lower portion of said inking pad only radially outwardly of said lower flange near the ink delivery surface of said inking pad, said lower flange overlying said ink conducting pad to be positioned between said inking pad and said ink conducting pad inwardly of said projecting portion, an ink reservoir in said hub, said hub and said lower flange isolating said inking pad from said ink reservoir whereby ink from said reservoir may be conducted to said inkink pad only at said exposed portion of said ink conducting pad, said ink conducting pad communicating in ink receiving relation with the ink reservoir to receive ink from said reservoir and conduct it to the portion thereof contacting said inking pad, means mounting said inking device for rotation on its axis, said inking pad having an exposed ink delivery surface above said lower portion, a business machine ink receiving means, means to advance said ink receiving means past said inking pad and to press it thereagainst at said ink delivery surface to pick up ink 6. A combination in accordance with claim 5 in which the ink receiving means is a ribbon and in which said inking pad is a tube which surrounds said hub between said lower flange and said retention means.

7. A combination in accordance with claim 6 in which the ink conducting pad is cocked-up near its outer periphery to contact said inking pad in a narrow band of contact only near the radially outer periphery of the inking pad.

8. A combination in accordance with claim 5 in which said ink receiving means is a type slug and in which said inking pad is a tube which surrounds said hub between said lower flange and said retention means.

9. A combination in accordance with claim 8 in which the ink conducting pad is cocked-up near its outer periphery to contact said inking pad in a narrow band of contact only near the radially outer periphery of the inking pad.

10. The combination which comprises an inking device including a spool-like body, said body having a hub, a lower flange extending radially outwardly from said hub, said hub being above said lower flange, an inking means on said hub above said lower flange, ink conducting means beneath said lower flange and having a portion thereof projecting outwardly from beneath said lower flange and in ink delivery contact with a lower portion of said inking means only radially outwardly of said lower flange near the ink delivery surface of said inking means, an ink reservoir in said hub, said ink conducting means communicating in ink receiving relation with the ink reservoir to receive ink from said reservoir and conduct it to the portion thereof in ink delivery contact with said inking means, said hub and said lower flange isolating said inking means from said ink reservoir whereby ink from said reservoir may be conducted to said inking means only at said exposed portion of said ink conducting means, said inking means having an exposed ink delivery means above said lower portion, said ink delivery means being adapted to be contacted by an ink receiving means and to deliver ink thereto.

11. A combination in accordance with claim 10 in which said inking means is a tube of cellular material which surrounds said hub above said lower flange.

12. A combination in accordance with claim 11 in which the ink conducting means is a pad of cellular material and in which said ink conducting pad is cocked-up near its outer periphery to contact said inking tube only near the radially outer periphery of the inking tube.

13. The combination which comprises an inking device including a spool-like body, said body having a hub, a lower flange extending radially outwardly from said hub, inking pad retention means on said hub, said hub being above said lower flange, a cellular polymeric inking pad on said hub above said lower flange and retained by said retention means, a cellular polymeric ink conducting pad beneath said lower flange and having a portion thereof projecting outwardly from beneath said lower flange and exposed to contact a lower portion of said inking pad only radially outwardly of said lower flange near the ink delivery surface of said inking pad, said lower flange overlying said ink conducting pad to be positioned between said inking pad and said ink conducting pad inwardly of said projecting portion, and ink reservoir in said hub, said ink conducting pad communicating in ink receiving relation with the ink reservoir to receive ink from said reservoir and conduct it to the portion thereof contacting said inking pad, said pad and said lower flange isolating said inking pad from said ink reservoir whereby ink from said reservoir may be conducted to said inking pad only at said exposed portion of said ink conducting pad, said inking pad having an exposed ink delivery surface above said lower portion, said inking pad being adapted to be contacted at said ink delivery surface by an ink receiving means and to deliver ink therefrom, a separable cap member adjacent said lower flange, a first depending rib on a wall defining said reservoir, said depending rib projecting toward said cap member, a cooperating upstanding rib on said cap member adjacent said depending rib and sealing thereagainst to close said reservoir against ink leakage past said ribs, said depending rib and said upstanding rib each having at least one opening therethrough, the openings through said ribs being positioned to be aligned to form an ink escape passage from said reservoir through said ribs, said upstanding rib being movable relative to said depending rib from a closed position in which the opening in one rib is closed by a facing portion of the other rib to close the reservoir to an open position to which the openings are so aligned, means mounting said inking device for rotation on its axis, a business machine ink receiving means and means to advance said ink receiving means past said inking pad and to press it thereagainst to pick up ink therefrom.

14. A combination in accordance with claim 13 in which said inking pad is a tube of cellular material which surrounds said hub between said lower flange and said retention means.

15. A combination in accordance with claim 14 in which said ink conducting pad is cocked-up near its outer periphery to contact said inking pad only near the radially outer periphery of the inking pad.

16. A method of replenishing ink to a printing device which comprising storing ink in a spool-like body in an ink reservoir located generally inwardly of the body hub, transmitting ink from the reservoir to an ink receiving portion of an ink conducting cellular pad, conducting ink through the ink conducting pad to a portion thereof lying exposed to the lower portion of a cellular inking pad mounted on said body, contacting the exposed portion of the ink conducting pad with only a lower portion of the inking pad and in a narrow zone adjacent the outer ink delivery surface of the inking pad, delivering ink from the reservoir to the inking pad only adjacent the outer portion of the inking pad at the contact with the ink conducting pad, and conveying ink upwardly of said inking pad by capillary action to the ink delivery portion of the inking pad.

17. A method in accordance with claim 16 in which the inking pad is a tube surrounding the hub, and in which the ink conducting pad is a washer-like pad that is cocked-up at its outer periphery to contact and deliver ink to the inking pad in a narrow band of contact therebetween near the outer periphery of the ink conducting pad.

18. A method in accordance with the claim 16 including contacting an ink receiving means with the inking pad to deliver ink to said ink receiving means, and carrying ink away from the inking pad on said ink receiving means.

19. A method in accordance with claim 18 in which the inking pad is a tube surrounding the hub, and in which the ink conducting pad is a washer-like pad that is cocked-up at its outer periphery to contact and deliver ink to the inking pad in a narrow band of contact therebetween near the outer periphery of the ink conducting pad.

20. A method in accordance with claim 19 in which ink is delivered to an ink receiving business machine ribbon and in which the ribbon is pressed against said inking pad and is advanced therepast while said device rotates on its axis to receive ink from the inking pad to carry it away therefrom.

21. A method in accordance with claim 19 in which ink is delivered to an ink receiving business machine type slug and in which the type slug is pressed against the said inking pad and advanced therepast while said device rotates on its axis to receive ink from the inking pad and to carry it away therefrom.

* * * * *